US005439264A

United States Patent [19]

Margiottiello

[11] Patent Number: 5,439,264

[45] Date of Patent: Aug. 8, 1995

[54] APPARATUS FOR LIFTING OBJECTS HAVING A HOLLOW CYLINDRICAL CORE

[76] Inventor: John Margiottiello, 3075 - 12th Avenue, Port Alberni, British Columbia, Canada, V9Y 1X2

[21] Appl. No.: 147,319

[22] Filed: Nov. 5, 1993

[30] Foreign Application Priority Data

Feb. 1, 1993 [CA] Canada ..... 2088539

[51] Int. Cl.[6] ..... B66C 1/54

[52] U.S. Cl. ..... 294/94; 294/86.25

[58] Field of Search ..... 294/93-97, 294/86.24, 86.25, 115, 116, 88, 906; 414/910, 911; 29/252

[56] References Cited

U.S. PATENT DOCUMENTS

| | | | |
|---|---|---|---|
| Re. 31,131 | 1/1983 | Torbet et al. | 294/95 X |
| 2,507,577 | 5/1950 | Reynolds | 294/94 |
| 2,768,019 | 10/1956 | Brooks | 294/95 |
| 3,052,494 | 9/1962 | Williamson | 294/93 |
| 3,485,388 | 12/1969 | Bohne | 214/1 |
| 3,905,636 | 9/1975 | Westerlund | 294/95 |
| 4,093,294 | 6/1978 | Taylor | 294/94 X |
| 4,784,398 | 11/1988 | Lund | 279/2 |
| 5,138,754 | 8/1992 | Casteel et al. | 294/94 X |

FOREIGN PATENT DOCUMENTS

| | | | |
|---|---|---|---|
| 70-950 | 2/1983 | European Pat. Off. | 294/96 |
| 169490 | 6/1990 | Japan | 294/96 |
| 703474 | 12/1979 | U.S.S.R. | 294/95 |
| 9006895 | 6/1990 | WIPO | 294/95 |

*Primary Examiner*—Dean J. Kramer
*Attorney, Agent, or Firm*—Oyen Wiggs Green & Mutala

[57] ABSTRACT

Prior lifting probes are heavy and awkward to manipulate and operate, and require that the paper roll be destroyed if the probe is jammed in the core of the roll. The present invention allows the main body of the device to be removed if the probe jams to have access to the core, and release the load automatically when the load is set down. It provides an apparatus for lifting objects having a vertically oriented, hollow cylindrical core comprising a) an aperture for connecting a hook or other lifting device; b) a face plate provided with a horizontal aperture; c) a body secured to the face plate having a threaded passageway extending Vertically therethrough for receiving a threaded rod; d) a linkage connecting the hook-connecting aperture to the face plate; e) a hollow sleeve dimensioned to be inserted into the core and comprising at the lower end thereof a plurality of jaw segments forming a diametrically expandable lower end; f) a transverse flange attached to the end of said sleeve having a diameter greater than that of the core; g) a latch assembly attached to the transverse flange and provided with a horizontally extending bolt biased to extend into the aperture in the face plate and a handle for releasably retracting the bolt; h) a rod extending through the sleeve threadably received by the threaded body at the upper end thereof and having at the lower end thereof an outwardly tapered end; and i) a spring biasing the rod downwardly in the sleeve.

4 Claims, 4 Drawing Sheets

APPARATUS FOR LIFTING OBJECTS HAVING A HOLLOW CYLINDRICAL CORE

TECHNICAL FIELD

The invention relates to devices for lifting, moving and handling paper rolls and similar massive articles having a central hollow cylindrical core.

BACKGROUND ART

Newsprint and similar materials are transported in large, massive rolls in which the sheet material is wound around a central cylindrical core of fiber or cardboard. Such objects are sufficiently heavy that they must be handled by crane for loading and unloading from vessels. They are readily damaged and so must be handled carefully in such loading and unloading. To facilitate loading and unloading such rolls, various core lifting chucks have been developed which have a probe which is inserted into the central cylindrical core of the roll and which grips the central core, to allow the roll to be lifted by a cable from a crane or the like.

For example, U.S. Pat. No. 3,905,636 issued Sep. 16, 1975 to AB Hagglund & Sons discloses a probe device having a lower probe section which is inserted into the hollow core of the paper roll. It consists of an inner component which is attached to the lifting cable and an outer component which is attached to a horizontal plate. Two lifting cables are attached to two long arms which in turn are connected to the inner component so that when the cables lift the ends of the two arms, the inner component is raised and the outer component is pressed downwardly. This causes a cone-shaped lower end of the inner component to force outwardly the ends of a number of pivoting fingers on the lower end of the outer component, which then engage and grip the inner core of the roll. When the roll is returned to the ground and the cables are released, the inner component drops back down, the fingers retract and the probe is removed from the core.

The problem with this existing prior art design is that since it requires two cables and two widely separated lifting arms, it is very cumbersome, heavy and unwieldy to operate, taking two persons to handle it. The width of the two arms, which frequently swing around during the loading process, causes safety problems. The two lines may become tangled. Further, when the fingers engage the cardboard core under considerable force they can become lodged therein and the roll cannot then be released from the probe. To remove the probe from the roll in that case it is necessary to destroy the paper roll at considerable expense and inconvenience. The arms and jaws on this device require frequent greasing to avoid jamming. It is also difficult to adjust the length of the probe. This cannot be done while the probe is in a roll. Also in this device, an operator must engage a locking device so that the probe can be removed from the roll once it is set down on the ground.

There is therefore a need for a compact lifting probe which can be readily removed from the roll core in case of jamming, is readily adjustable, and which is self-releasing when the load is to be released.

DISCLOSURE OF INVENTION

The invention provides an apparatus for lifting objects having a vertically oriented, hollow cylindrical core comprising a) means for connecting a hook or other lifting device; b) a face plate provided with a horizontal aperture; c) a body secured to the face plate having a threaded passageway extending vertically therethrough for receiving a threaded rod; d) linkage means connecting the hook-connecting means to the face plate; e) a hollow sleeve dimensioned to be inserted into the core and comprising at the lower end thereof a plurality of jaw segments forming a diametrically expandable lower end; f) a transverse flange attached to the end of said sleeve having a diameter greater than that of the core; g) a latch assembly attached to the transverse flange and provided with a horizontally extending bolt biased to extend into the aperture in the face plate and handle means for releasably retracting the bolt means; h) a rod extending through the sleeve threadably received by the threaded body at the upper end thereof and having at the lower end thereof an outwardly tapered end; and i) spring means biasing the rod downwardly in the sleeve.

In a further embodiment, the mechanical linkage is replaced by a power-actuated hydraulic or air cylinder.

BRIEF DESCRIPTION OF DRAWINGS

In drawings which illustrate a preferred embodiment of the invention.

BEST MODE FOR CARRYING OUT THE INVENTION

Figure 1:
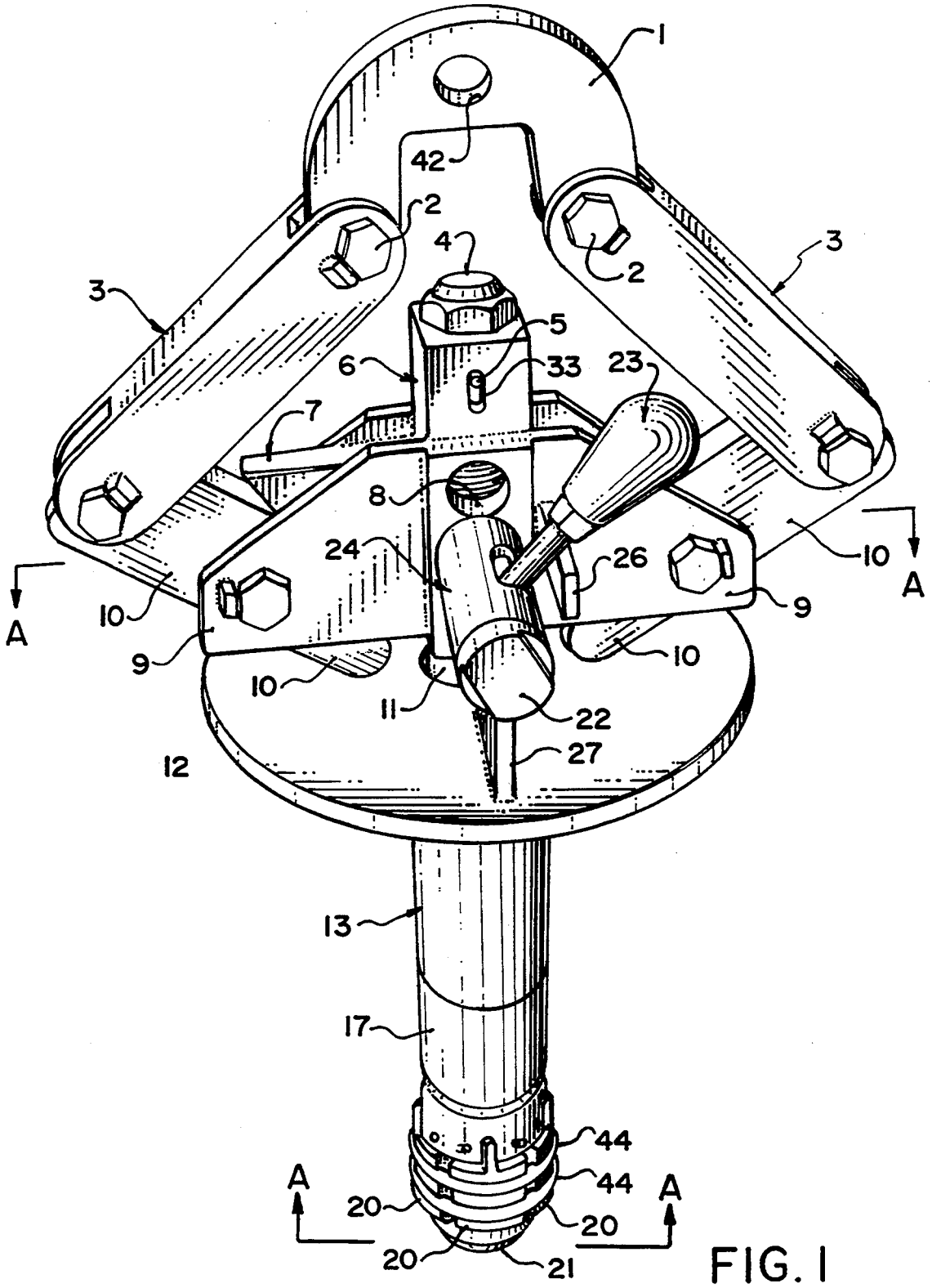
FIG. 1 is a perspective view from above of the probe of the invention.

With reference to the drawings, the lifting device of the invention is designated generally as 40. It has a horseshoe shaped plate 1 which is provided with hole 42 through which a hook or cable is inserted to lift the device. Two pairs of link plates 3 are pivotally attached to each arm of plate 1 by capscrew and nyloc nut assemblies 2. Toggle arms 10 are pivotally attached at one end thereof between each pair of link plates 3 and at the other end thereof between toggle assembly plates 9. Toggle assembly plates 9 are welded to threaded block 6 to which are also welded toggle stops 7 which limit the upward movement of the toggle arms 10. A latch assembly, described in further detail below, is mounted in the front of toggle assembly plate 9, and plate 9 is provided with hole 8 to receive the latch plunger 25 (FIG. 3) when the toggle arms are in the lowered position.

Forming the lower part of the device is a circular plate 12 provided with a central aperture in which is welded a hollow cylindrical sleeve 13. Expanding segments 20 are held by a segment holder 17 which is threaded into the lower end of sleeve 13. There will generally be 4 of the segments 20, which pivot outwardly on pin 18 and are provided with two $\frac{1}{4}$ inch rubber O-rings 44 in slots 46 which bias the segments inwardly and assist in the gripping function of the segments. Conical mandrel 21 is fixed to threaded block 48 which receives threaded drawbolt or "redi-rod" 14 which will typically be 1-inch diameter. An angle C for the mandrel 21 of 19 degrees has been found to be optimal. Drawbolt 14 is locked into block 48 by locking pin 16. A spring 15 is provided around the drawbolt 14 between shoulder 50 of block 48 and annular spacer 52 which is welded to the interior of sleeve 13. The upper end of drawbolt 14 passes through sleeve 11 and is threaded into threaded block 6. A lock pin 5 extends through slots 33 in either side of block 6 and through a slot in drawbolt 14 to prevent it from turning once it is in place. Nyloc nut 4 seals the upper end of the block 6. The typical length of the probe portion of the device (parts 13, 17, 20) is 16 inches, and the maximum width of the mechanism is about 33 inches.

Figure 3:
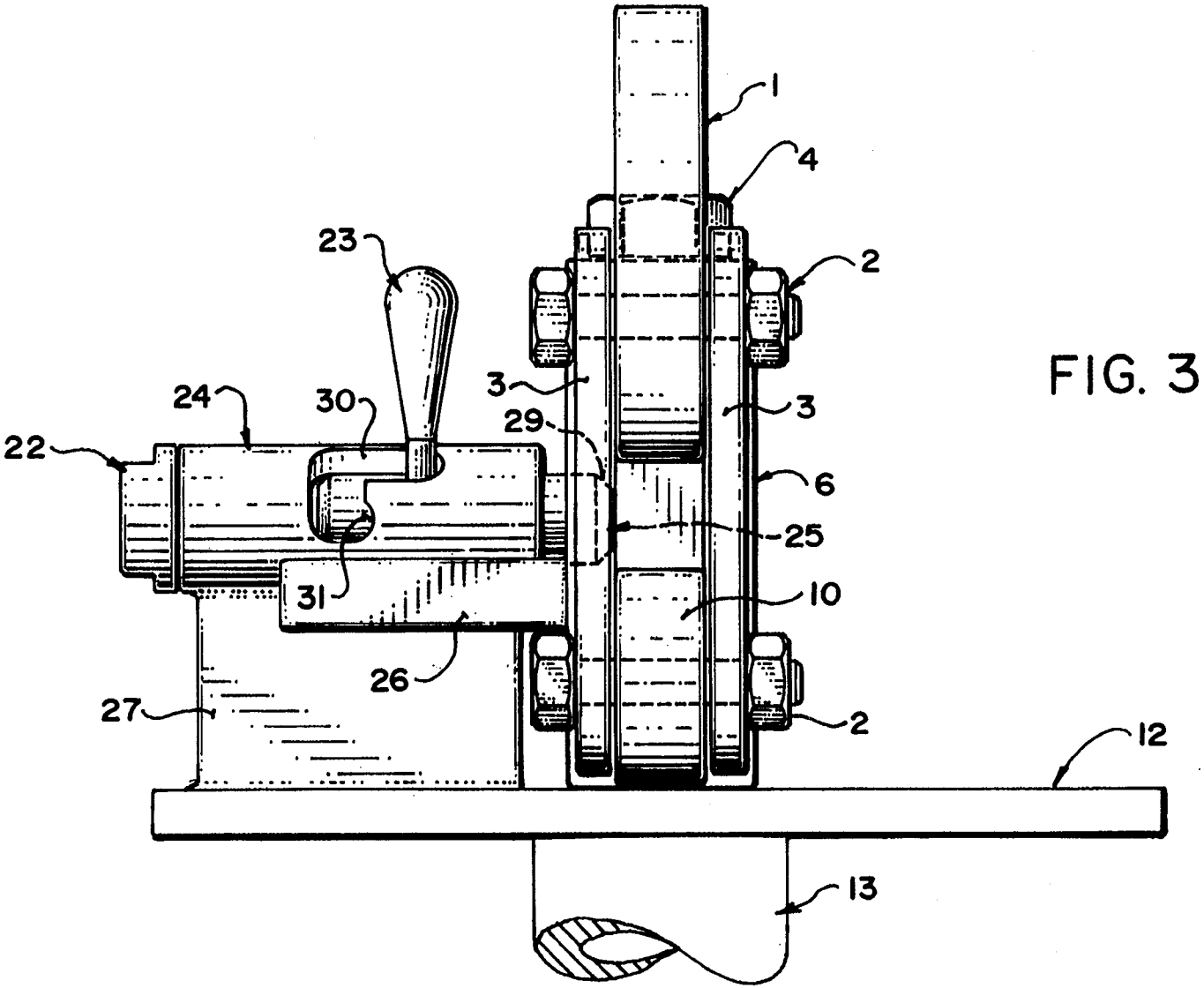
FIG. 3 is a detailed right side view of the latch portion of the probe illustrated in FIG. 2 with the toggle arms in a lowered position.

Looking at FIG. 3, latch assembly 8 consists of latch handle 23, hollow cylindrical latch barrel 24, latch plunger 25 and latch cap 22. A spring is provided within latch barrel 24 between cap 22 and plunger 25 to bias the plunger to the right in FIG. 3. Latch plunger 25 has a tapered end 29. Latch barrel 24 has a slot 30 through which latch handle 23 extends, with notch 31. Latch barrel 24 is welded to a mounting plate 27 which is in turn welded to the top of circular plate 12. Trigger 26 is a horizontally extending bar welded at one end to the front of plate 9.

Figure 2:
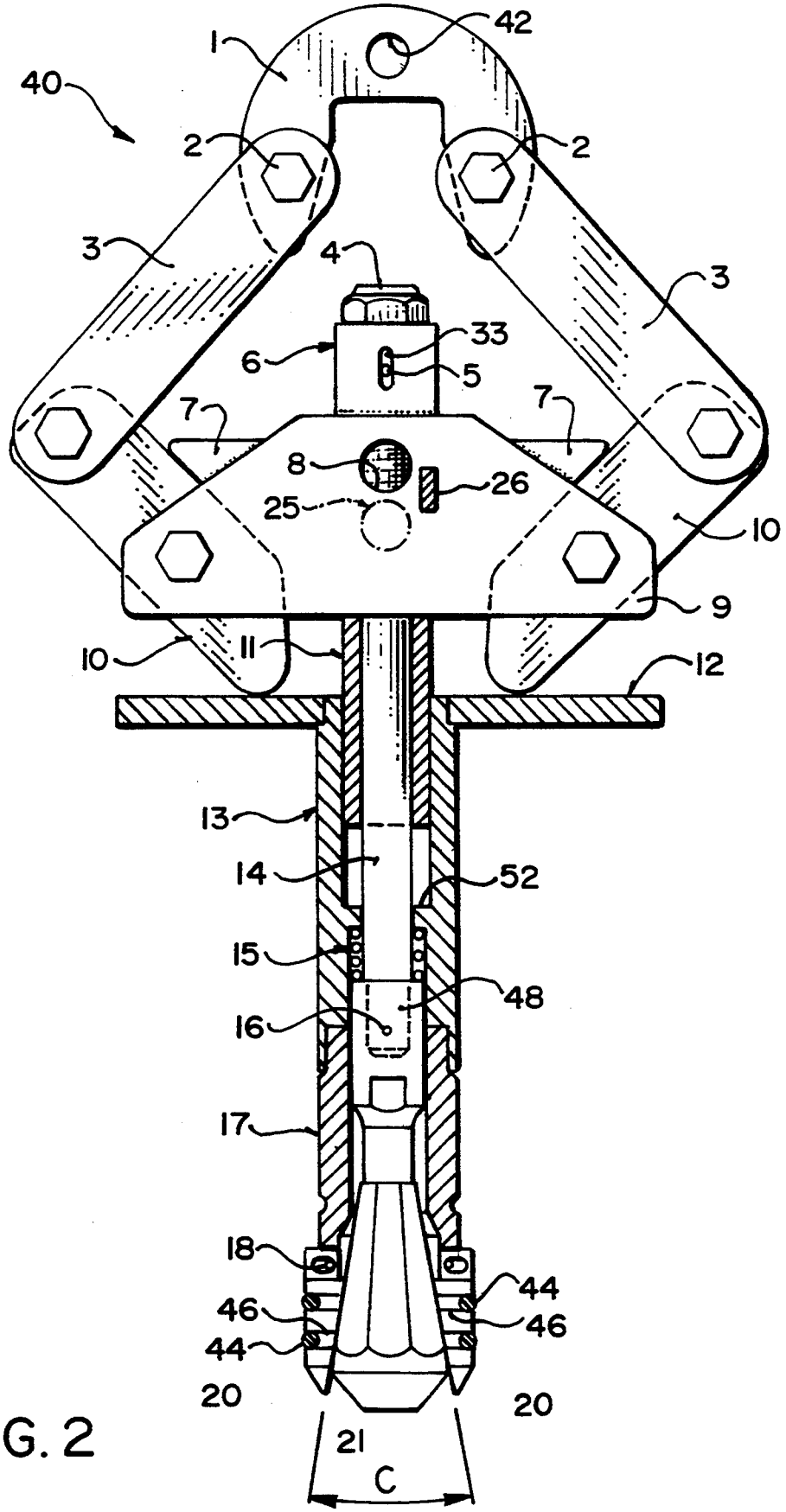
FIG. 2 is an elevation view, partly in cross section along line A—A of FIG. 1, of the probe of the invention with the toggle arms in raised position.

The latch assembly permits operators to automatically release the lifting mechanism from a roll after a roll has been lifted and placed on the ground. In the lowered position, latch handle 23 is in the position shown in FIG. 3 with end 29 of the latch plunger 25 extending into hole 8 of plate 9. In this position the lifting mechanism 10 can be lifted by plate 1 into and out of the centers of rolls without gripping, since the toggle arms are held in the lowered position. When the mechanism 10 has been placed into a position for lifting a roll, latch handle 23 is pulled back to rest in notch 31, thus removing end 29 of plunger 25 from hole 8. When the device is lifted from plate 1, plate 9 moves upwardly to the position shown in FIG. 2. This causes trigger 26 to bear against handle 23, pushing it upwardly in slot 30, and the action of the spring (not shown) in barrel 24 causes the end 29 of plunger 25 to press against the front face of plate 9. When the mechanism 10 and attached roll are lowered to the ground, the plate 9 lowers until hole 8 is aligned with plunger 25, and end 29 extends into hole 8. The mechanism 10 can then be lifted out of the roll with the toggle arms locked in the lower position.

To operate the mechanism 10, the device is attached to the lifting cable of a crane or the like through hole 42. With the toggle arms latched in the lowered position, it can be lifted by the cable and inserted into the central core of the paper roll, which has a diameter slightly greater than the diameter of sleeve 13 (for newsprint this is typically 3 inches, 4 inches for Kraft rolls). Once the plate 12 is lowered into contact with the roll, latch handle 23 is pulled back into notch 31 as noted above. Lifting of the plate 1 now causes sleeve 11 and drawbolt 14 to be drawn upwardly with respect to sleeve 13, and mandrel 21 is similarly forced upwardly through segments 20, causing them to be forced or wedged outwardly into firm engagement with the inner surface of the core of the roll. The mechanical advantage provided by the camming action of toggle arms 10 against plate 12 greatly increases the force with which the outer surface of segments 21 and the related O-rings are driven against the inner core of the roll to ensure firm gripping. The mechanical advantage thereby obtained is about 3.5:1. The roll can then be lifted and manipulated into place and is automatically released by the latching mechanism when the roll is placed on a supporting surface and the toggle arms lowered.

The length of the probe can be adjusted, even with the probe inserted in a roll, by removing lock pin 5 from drawbolt 14 and slot 33, removing nut 4, and turning the drawbolt 14 in threaded block 6 to the desired level, either by turning the lower end of mandrel 21 or by using a screwdriver in a slot in the top of the drawbolt. To remove the mechanism entirely from a roll when the segments 20 are jammed into a core, the nut 4 is removed and drawbolt 14 is unscrewed downwardly from block 48 so that the mandrel and attached drawbolt fall out the bottom of the device. The upper portion of the mechanism (apart from the circular plate 12 and parts 13, 17, 20) can then be removed so that access can be had to segments 20.

Figure 4:
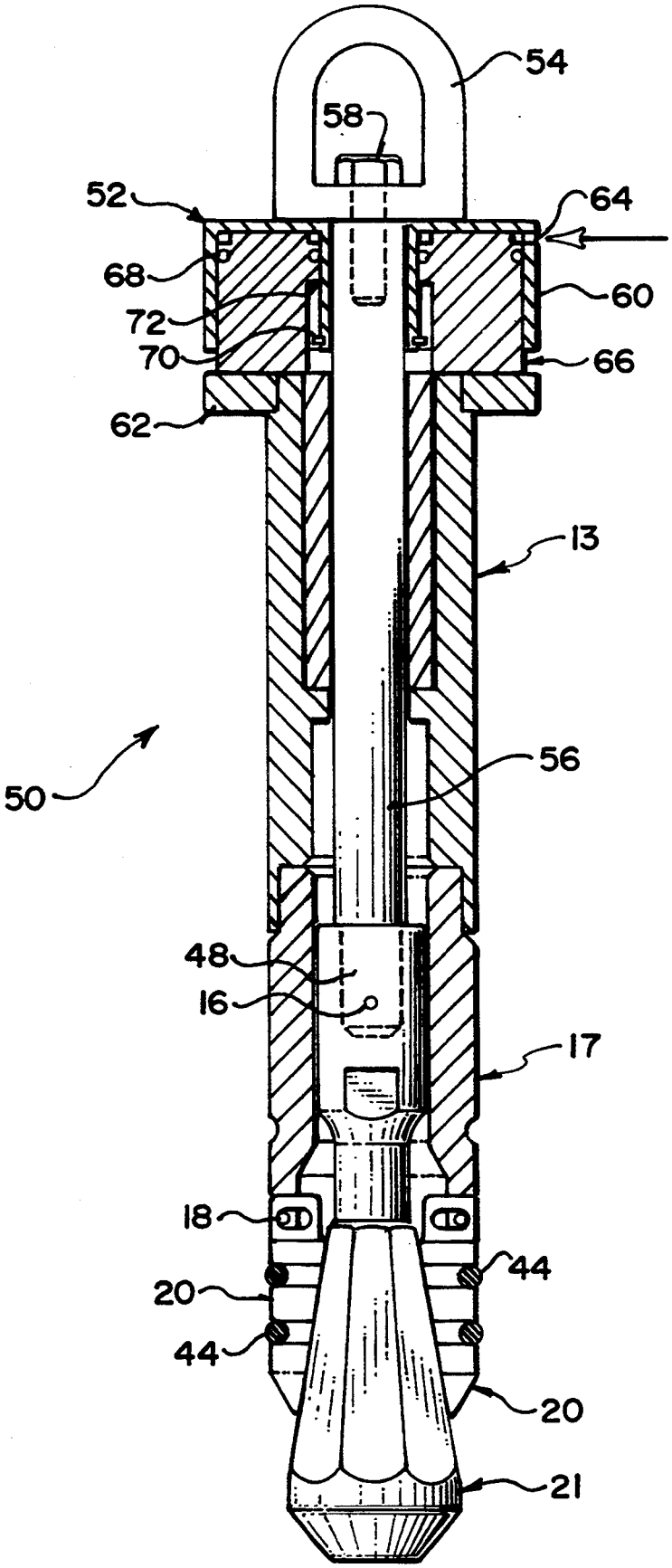
FIG. 4 is an elevation view, partly in cross section of a second form of probe using power-actuated cylinders.

FIG. 4 illustrates a lifting probe 50 in which power-actuated cylinders 52, whether hydraulic or air, replace the mechanical action of the toggle arms. It has a lifting ring 54 to which the lifting cable may be attached, which is welded or otherwise secured to the upper surface of the outer cylindrical casing 60 of cylinders 52. Cylindrical casings 60 slide up ad down on solid cylinders 66. Sealing rings 68 form a seal between cylinders 66 and casing 60. The upward movement of the casing 60 is stopped by rim 70 bearing against shoulder 72. The central rod 56 is bolted to the ring 54 by bolt 58, and has the mandrel 21 secured to its lower end. Again the mandrel has a preferred taper of 19 degrees. Sleeve 13, segment holder 17 and segments 20 are structured as in the previous embodiment, with rubber O-rings 44 encircling segments 20. The upper end of sleeve 13 is welded to an annular flange 62 which is narrower in diameter than plate 12. A source of pressurized hydraulic fluid or air (not shown) provides air or hydraulic fluid under pressure through an inlet 64 into the area between casing 60 and cylinder 66.

In operation, the lower probe portion of this embodiment (parts 13, 17, 20) is lowered into the core of the roll by lifting ring 54 with the mandrel in the position shown in FIG. 4 and the source of pressurized hydraulic fluid or air cut off from cylinders 52. When the probe is in position, with flange 62 resting on the upper surface of the roll, the passage of pressurized hydraulic fluid or air is opened to cylinders 52 and the resulting pressure drives drawbolt 56 and attached mandrel 21 upwardly with respect to sleeve 13 and segments 20, spreading segments 20 outwardly so that they and O-rings 44 bear against the inner surface of the roll core. The roll can then be lifted from ring 54 and manipulated. When it is placed in its resting position, the source of pressurized hydraulic fluid or air is again cut off from cylinders 52, mandrel 21 drops downwardly, and the probe can be removed from the roll.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Apparatus for lifting objects having a vertically oriented, hollow cylindrical core comprising:

a) means for connecting a hook or other lifting device;

b) a vertically-extending plate having front and rear surfaces provided with a horizontal aperture in said front surface;

c) a threaded housing secured to the rear surface of said vertically-extending plate having a threaded passageway extending vertically therethrough for receiving a threaded rod;

d) linkage means connecting said means for connecting a hook to said vertically-extending plate;

e) a hollow sleeve having an upper end and a lower end and dimensioned to be inserted into said core and comprising at the lower end thereof a plurality of pivotable jaw segments forming a diametrically expandable lower end;

f) a transverse plate having upper and lower surfaces, said upper surface of said plate being attached to the upper end of said sleeve, said transverse plate having a diameter greater than said core;

g) a latch assembly attached to the upper surface of said transverse plate and provided with a horizontally extending bolt biased to extend into said aperture in said vertically-extending plate when said vertically-extending plate is in a lowered position and handle means for releasably retracting said bolt from a first extended position into a second retracted position;

h) a rod extending through said hollow sleeve threadably received by said threaded housing at the upper end thereof and having secured to the lower end thereof a mandrel having outwardly tapered sides adapted to engage said pivotable jaw segments; and i) spring means positioned co-axially in said hollow sleeve and having upper and lower ends, engaging at the upper end thereof an inward extension of said hollow sleeve and at the lower end thereof an outer extension of said rod, thereby biasing said rod downwardly in said hollow sleeve.

2. The apparatus of claim 1 further comprising a rubber O-ring encircling said diametrically expandable lower end.

3. The apparatus of claim 1 further comprising a handle-engaging element extending horizontally from said front surface of said vertically-extending plate in a position adapted to engage said handle means and release said bolt when said means for connecting a hook is lifted and said vertically-extending plate has moved upwardly relative to said latch assembly; whereby when said bolt of said latch assembly is in said second retracted position, and said means for connecting a hook is lifted, said vertically-extending plate and connected threaded housing and rod are lifted relative to said hollow sleeve and said mandrel engages said expandable jaws, and said handle-engaging element releases said bolt of said latch assembly to said first extended position bearing against said front surface of said vertically-extending plate, and when said means for connecting a hook is lowered, said vertically-extending plate and connected threaded housing and rod are lowered relative to said hollow sleeve and said mandrel disengages from said expandable jaws, and said bolt of said latch assembly extends into said aperture in said vertically-extending plate.

4. The apparatus of claim 1 wherein said linkage means comprises two arms each pivotally connected at one end thereof to said means for connecting a hook, the other end thereof adapted to bear against the upper surface of said transverse plate, and each arm being pivotally connected to said vertically-extending plate at a point intermediate said first and second ends.

* * * * *